United States Patent [19]

Frauenfeld

[11] 4,141,754

[45] Feb. 27, 1979

[54] APPARATUS AND METHOD FOR CLEANING THE HEAT EXCHANGING SURFACES OF THE HEAT TRANSFER PLATES OF A ROTARY REGENERATIVE HEAT EXCHANGER

[75] Inventor: Martin Frauenfeld, Heidelberg, Fed. Rep. of Germany

[73] Assignee: Svenska Rotor Maskiner Aktiebolag, Nacka, Sweden

[21] Appl. No.: 795,605

[22] Filed: May 10, 1977

[51] Int. Cl.[2] ..... B08B 9/04; B08B 3/00

[52] U.S. Cl. ..... 134/24; 134/36; 134/37; 134/102; 134/152; 165/5; 165/95; 239/419.5

[58] Field of Search ..... 134/24, 34, 37, 36, 134/102, 152, 167 R, 171, 172; 165/95, 5; 239/186, 419.5, 8, 9

[56] References Cited

U.S. PATENT DOCUMENTS

| | | | |
|---|---|---|---|
| 2,766,969 | 10/1956 | Cooper et al. | 165/5 |
| 3,462,083 | 8/1969 | Kautz | 134/102 |
| 3,724,762 | 4/1973 | Freshour et al. | 239/419.5 |
| 4,025,362 | 5/1977 | Frauenfeld | 165/5 |

*Primary Examiner*—Richard V. Fisher
*Assistant Examiner*—George C. Yeung
*Attorney, Agent, or Firm*—Flynn & Frishauf

[57] ABSTRACT

Apparatus and method for cleaning the heat exchanging surfaces of the heat transfer plates of rotary regenerative heat exchangers comprising low to medium pressure gas and/or steam operated nozzles of the injection type having injection tubes for moving by suction ambient heat exchanging gas or air into the interspaces between the heat transfer plates. The nozzles may be designed as supersonic nozzles, especially Laval nozzles.

17 Claims, 1 Drawing Figure

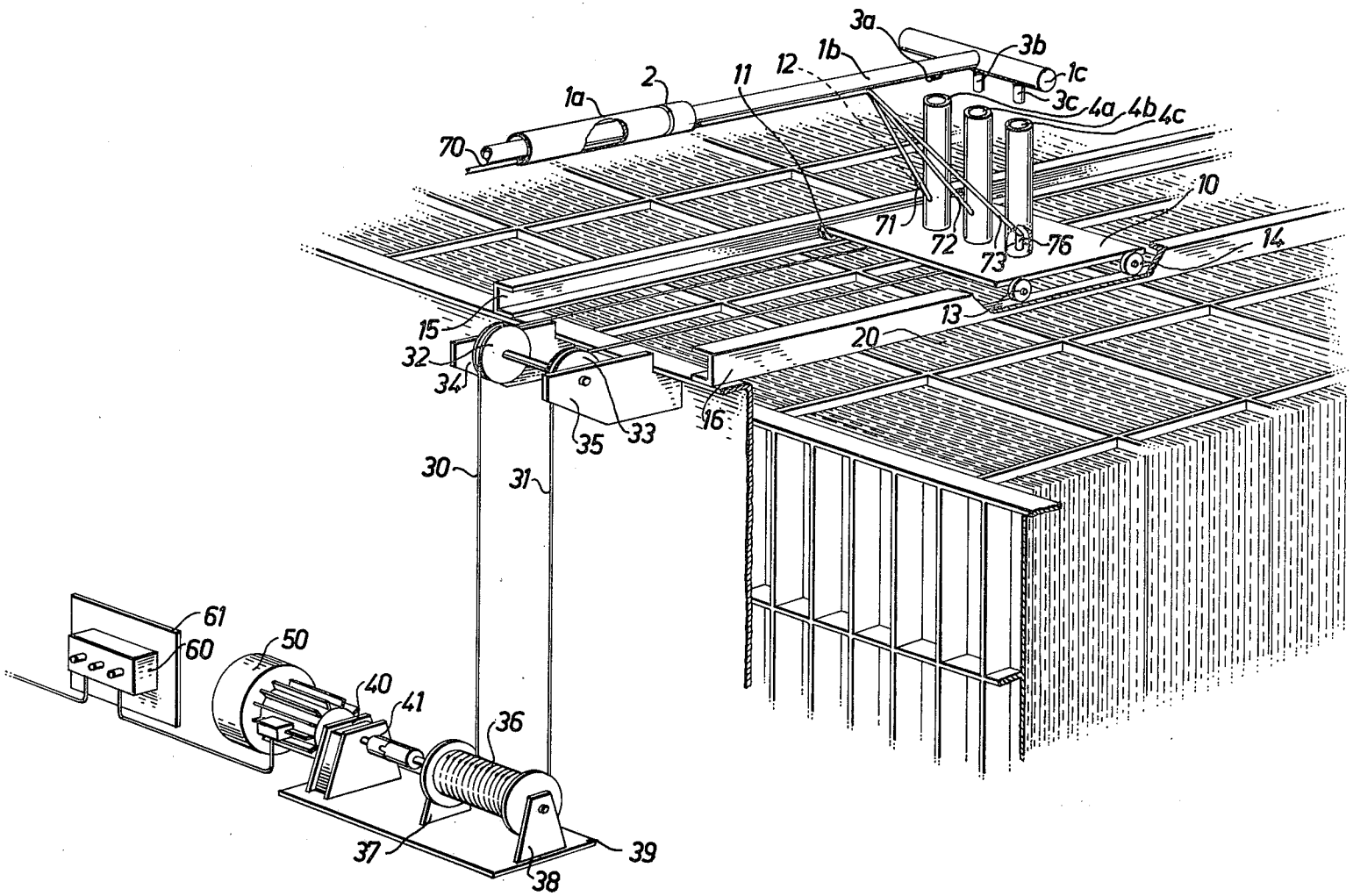
1a
1b
1c
2
3a
3b
3c
4a
4b
4c
10
11
12
13
14
15
16
20
30
31
32
33
34
35
36
37
38
39
40
41
50
60
61
70
71
72
73
76

APPARATUS AND METHOD FOR CLEANING THE HEAT EXCHANGING SURFACES OF THE HEAT TRANSFER PLATES OF A ROTARY REGENERATIVE HEAT EXCHANGER

This invention relates to an apparatus for cleaning the heat exchanging surfaces of the heat transfer plates of a rotary regenerative heat exchanger, comprising a plurality of cleaning fluid nozzles directed towards the heat transfer plates, said nozzles being positioned adjacent each other on at least one line and substantially in parallel to the planes of the heat transfer plates, and means for radially displacing said nozzles relative to the planes of said plates. The invention also relates to a suitable method in which the apparatus may be utilized.

The heat exchanging surfaces of the heat transfer plates of rotary regenerative heat exchangers frequently have to be cleaned in order to remove deposits from said surfaces and from the interspaces between said surfaces.

A great number of methods have been suggested in order to increase the cleaning effect of steam and/or compressed air on the surfaces of the heat transfer plates. U.S. Pat. No. 2,766,969, for example, discloses a cleaning device comprising a tube provided with a great number of apertures or nozzles which is positioned in an interspace between two layers of heat transfer elements.

Cleaning devices for regenerative heat exchangers of the type having stationary heat transfer elements and rotating air and gas ducts are also known (German utility patent Nos. 1,904,117 and 1,933,202). Such known devices generally comprise nozzles movable step by step in a circular path together with the rotating hubs of the heat exchangers.

By using a single nozzle or pairs of nozzles, cleaning jets of very high intensity can be obtained utilizing a high pressure in connection with saturated steam and compressed air, respectively, which improves the cleaning effect on fixedly attached deposits on the surfaces of the heat transfer plates but often gives rise to considerable damage of the heat transfer plates.

A more indulgent but still very advantageous cleaning device is suggested in my U.S. patent application Ser. No. 672,427, now U.S. Pat. No. 4,025,362. This device comprises a plurality of cleaning fluid (water) nozzles directed towards the heat transfer plates, the nozzles being positioned adjacent each other on at least one line and essentially in parallel to the planes of the heat transfer plates and displaceable relative to the planes, each of which nozzles being dimensioned to produce a directional jet of high kinetic energy with a cylindrical or flat sectional area that at least perpendicular to the planes of said heat transfer plates essentially does not increase in size. A cleaning liquid source is coupled to said nozzles for supplying said cleaning fluid nozzles with a high pressure cleaning liquid.

Preferably a first row of cleaning nozzles and behind them a second row of low-pressure washing nozzles are supported by a carriage provided with wheels guided by two fixed rails. The carriage is movable along said rails in a radial direction with respect to the heat transfer plates. It is very surprising that the high pressure jets do not impart vibrations followed by damage to the plates. This is due to the fact that the jets hit the deposits attached to the plates at points which are moved slowly over the surface of the plates. After the deposits have been more or less loosened, they are preferably washed away by the washing jets of lower energy acting during a comparatively long time period. Due to the fact, however, that water is used as a cleaning fluid the cleaning device cannot be used when the boiler is in operation. Moreover, when a plant is started from cold conditions, water condenses on the heat transfer plates as the plate temperatures are lower than the water dew point of the gas. If the plates are not heated above the water dew point of the gas and dried quickly enough and/or cleaned quickly enough, deposits will rapidly be formed on the plates, which deposits in the presence of water will harden to a layer as hard as cement. Secondary deposits will be formed on the primary layer giving rise to clogging in an increasing zone of the heat transfer element mass which in turn is followed by an increased pressure drop over the element mass. This explains the difficulties in cleaning air preheaters when deposits have started accumulating in especially the cold end layer. The remaining pressure drop after soot blowing increases with time, and the blowing medium velocity decreases to a value where no cleaning effect can be obtained.

It is an object of the present invention to achieve an improved cleaning apparatus and method by means of which particles having a tendency to adhere to the heat transfer plates are removed in time for preventing the formation of the above mentioned primary and secondary layers of deposits. This has been achieved according to the invention by utilizing the apparatus and method defined in the accompanying claims.

SUMMARY OF THE INVENTION

In accordance with the present invention, apparatus for cleaning the heat exchanging surfaces of spaced-apart heat transfer plates of a rotary regenerative heat exchanger comprises a plurality of injection-type nozzles directed towards the heat transfer plates, which are generally moving, the injection nozzles being positioned adjacent each other on at least one line and substantially in parallel to the planes of the heat transfer plates. Further provided is means for supplying a low to medium pressure cleaning fluid to the injection nozzles and a plurality of injection tubes respectively arranged in line with the output jets from the injection nozzles and located between respective injection nozzles and the heat transfer plates. The injection tubes are actuated by the injection nozzles to move by suction the ambient heat exchanging medium through the injection tubes to be mixed with the cleaning fluid and to supply the mixed cleaning fluid and ambient heat exchanging medium to the interspaces between the heat transfer plates as directional jets having substantially equalized velocities all over the cross-sectional area of each of the injection nozzles. Means is provided for radially displacing the injection nozzles and the injection tubes relative to the planes of the heat transfer plates.

BRIEF DESCRIPTION OF THE DRAWING

The drawing is a fragmentary perspective view of a rotary regenerative heat exchanger having the major part of its housing omitted.

DETAILED DESCRIPTION

Before starting and stopping a boiler connected to the heat exchanger shown in the drawing a low or medium pressure gas or steam containing agent is supplied to an ejector means via a tube means 1 which comprises two telescopic tube portions 1*a*, 1*b* slidingly engaging each other via a gastight sealing member 2. A distribution tube 1c is secured to the free end of the tube portion 1b. The distribution tube 1c distributes the blowing fluid to injection nozzles 3a, 3b and 3c positioned in the bottom wall portion of the distribution tube 1c. The nozzles form directional jets of the blowing fluid, which jets are supplied to injection tubes 4a, 4b, 4c positioned in line with the jets such that ambient heat exchanging gas or air is sucked into the tubes. The mixture of blowing fluid and gas or air sucked into the tubes form directional jets which are directed towards the surfaces of the heat transfer plates 20 to be cleaned.

Injection tubes 4a, 4b, 4c, the tube portion 1b and the distribution tube 1c are attached to a carriage 10 by means of support members not shown, which carriage 10 is provided with wheels 11, 12, 13 and 14 permitting the carriage to be moved along guide rails 15, 16. The operating movement of the carriage 10 is performed by means of two ropes 30, 31 extending around two guide rolls 32, 33 supported by cantilever arms 34, 35. The ropes 30, 31 connect the carriage 10 with a winch 36 supported by cantilever arms 37, 38, which in turn are supported by a base plate 39 to which further cantilever arms 40, 41 are attached supporting a driving motor 50. A control device 60 mounted on a mounting plate 61 controls the velocity of the winch 36 via a device for regulating the velocity of the motor 50 in relation to the peripheral velocity of the actual heat transfer plates just being cleaned such that increasing peripheral velocities are accompanied by longer operating time periods of the cleaning fluid jets.

A main tube 70 for a high pressure cleaning agent is attached to the under side of the telescopic tube portions 1a, 1b supplying a low pressure cleaning agent. The main tube 70 is connected to branch tubes 71, 72, 73 communicating with high pressure nozzles 76 arranged in the centre line of each injection tube 4a, 4b, 4c. Only one of the high pressure nozzles 76 is shown on the drawing.

The operating of the high pressure cleaning nozzles 76 differs from that of the injection nozzles 3a, 3b, 3c in that the high pressure nozzles are in operation only when required for removing very fixedly adhering deposits or particles.

The cleaning fluid may be supplied to the injection nozzles 3a, 3b, 3c having an aperture diameter of 15 to 20 mm at a pressure of at least 4 atm and the diameter of the injection tubes 4a, 4b, 4c may be about 100 mm. The high pressure nozzles 76 may have a diameter of about 1.5 to 2.2 mm and may be supplied with the cleaning liquid at a pressure of 200 to 400 atm.

The cleaning fluid supplied to the injection nozzles 3a, 3b, 3c may consist of gas or steam, preferably superheated steam at a pressure of at least 4 atm and a temperature of about 300° C. The high pressure nozzles 76, which are operated when necessary, may be supplied with water as a cleaning fluid.

I claim:

1. A method for cleaning the heat exchanging surfaces of the heat transfer plates of a rotary regenerative heat exchanger comprising:

directing nozzles which produce directional jets of a cleaning agent towards the heat exchanging surfaces of the heat transfer plates, said nozzles producing at least one high velocity cleaning jet in the form of steam or gas and having a cylindrical or flat sectional area that does not increase essentially in a plane perpendicular to the plane of said heat transfer plates, said cleaning jet being generated by said nozzles in a plane substantially parallel to the planes of said heat transfer plates;

directing said at least one cleaning jet into an injection tube such that ambient heat exchanging gas or air is sucked into the tube and admixed with said cleaning jet under the influence of injection effect, and directing said admixed cleaning jet and heat exchanging medium towards the surfaces to be cleaned by said injection tube, and operating a means for radially displacing the nozzles and injection tube relative to the planes of said heat transfer plates.

2. A method as claimed in claim 1 wherein said cleaning agent comprises steam having a pressure of at least 4 atm.

3. A method as claimed in claim 1 comprising directing a liquid cleaning agent via high pressure nozzles into said directional jets of cleaning agent.

4. Apparatus for cleaning the heat exchanging surfaces of the spaced-apart heat transfer plates (20) of a rotary regenerative heat exchanger, comprising:

a plurality of injection-type nozzles (3a, 3b, 3c) directed towards the heat transfer plates, said injection nozzles being positioned adjacent each other on at least one line and substantially in parallel to the planes of the heat transfer plates;

means for supplying a low to medium pressure cleaning fluid as gas and/or steam to said injection nozzles (3a, 3b, 3c);

a plurality of injection tubes (4a, 4b, 4c) respectively arranged in line with the output jets from said injection nozzles and located between respective injection nozzles and said heat transfer plates, said injection tubes being actuated by said injection nozzles to move by suction the ambient heat exchanging medium through said injection tubes to be mixed with said cleaning fluid and to supply said mixed cleaning fluid and ambient heat exchanging medium to the interspaces between the heat transfer plates (20) as directional jets having substantially equalized velocities all over the cross sectional area of each of said injection nozzles; and means (10) for radially displacing said injection nozzles and injection tubes relative to the planes of said plates.

5. Apparatus as claimed in claim 4 wherein said heat transfer plates (20) are moved during operation of the cleaning apparatus.

6. Apparatus as claimed in claim 4 wherein said injection nozzles (3a, 3b, 3c) are supersonic nozzles.

7. Apparatus as claimed in claim 6 wherein said injection nozzles are Laval nozzles.

8. Apparatus as claimed in claim 4 comprising high pressure nozzles (76) mounted in communication with the jet outputs of said injection nozzles, said high pressure nozzles and said injection nozzles being mounted in displaceable relation to said heat transfer plates (20).

9. Apparatus as claimed in claim 8 including means (70) for feeding a liquid cleaning agent to said high pressure nozzles (76).

10. Apparatus as claimed in claim 8 wherein said high pressure nozzles (76) are positioned substantially centrally in the interior of respective injection tubes (4a, 4b, 4c) close to the outlet openings of said injection tubes.

11. Apparatus as claimed in claim 10 including means (70) for feeding a liquid cleaning agent to said high pressure nozzles (76).

12. Apparatus as claimed in claim 4 wherein said displacing means includes a carriage (10) supporting said injection nozzles (3*a*, 3*b*, 3*c*) and injection tubes (4*a*, 4*b*, 4*c*), said carriage (10) having wheels (11–14) thereon by means of which the carriage (10) is movable within the heat exchanger housing on radially extending rails (15, 16).

13. Apparatus as claimed in claim 8 wherein said displacing means includes a carriage (10) supporting said injection nozzles (3*a*, 3*b*, 3*c*), said high pressure nozzles (76) and said injection tubes (4*a*, 4*b*, 4*c*), said carriage (10) having wheels (11–14) thereon by means of which the carriage (10) is movable within the heat exchanger housing on radially extending rails (15, 16).

14. Apparatus as claimed in claim 4 wherein said cleaning fluid is fed to said injection nozzles at a feeding pressure of at least 4 atm; said injection nozzles have an inner diameter of about 15 to 20 mm; and said injection tubes have a diameter of about 100 mm.

15. Apparatus as claimed in claim 9 wherein said cleaning fluid is fed to said injection nozzles at a feeding pressure of at least 4 atm; said injection nozzles have an inner diameter of about 15 to 20 mm; and said injection tubes have a diameter of about 100 mm.

16. Apparatus as claimed in claim 15 wherein said liquid cleaning agent is fed to said high pressure nozzles (76) at a feeding pressure of about 200–400 atm; and said high pressure nozzles (76) have an inner diameter of about 1.5 to 2.2 mm.

17. Apparatus as claimed in claim 9 wherein said liquid cleaning agent is fed to said high pressure nozzles (76) at a feeding pressure of about 200–400 atm; and said high pressure nozzles (76) have an inner diameter of about 1.5 to 2.2 mm.

* * * * *